United States Patent [19]

Kumazawa

[11] 3,947,296

[45] Mar. 30, 1976

[54] PROCESS FOR PRODUCING STEEL SHEET OF CUBE-ON-FACE TEXTURE HAVING IMPROVED MAGNETIC CHARACTERISTICS

[75] Inventor: Masuji Kumazawa, Himeji, Japan

[73] Assignee: Nippon Steel Corporation, Tokyo, Japan

[22] Filed: Dec. 14, 1973

[21] Appl. No.: 424,743

[30] Foreign Application Priority Data

Dec. 19, 1972 Japan ..... 47-126736

[52] U.S. Cl. ..... 148/111; 148/112; 148/31.55

[51] Int. Cl.[2] ..... H01F 1/04

[58] Field of Search ..... 148/111, 112, 120, 121, 148/11.5, 12.1, 31.55, 12

[56] References Cited

UNITED STATES PATENTS

| | | | |
|---|---|---|---|
| 3,266,955 | 8/1966 | Taguchi et al. | 148/111 |
| 3,337,373 | 8/1967 | Foster et al. | 148/31.55 |
| 3,347,718 | 10/1967 | Carpenter et al. | 148/111 |
| 3,351,501 | 11/1967 | Aspden | 148/112 |
| 3,647,575 | 3/1972 | Fiedler et al. | 148/111 |

*Primary Examiner*—Walter R. Satterfield

*Attorney, Agent, or Firm*—Toren, McGeady and Stanger

[57] ABSTRACT

A process for producing an electrical steel sheet composed of cubic-on-face texture which comprises subjecting hot rolled steel sheet to primary cold rolling with a grooved roll then to a secondary cold rolling with smooth rolls, further to decarburization annealing and final finishing annealing.

2 Claims, 5 Drawing Figures

PROCESS FOR PRODUCING STEEL SHEET OF CUBE-ON-FACE TEXTURE HAVING IMPROVED MAGNETIC CHARACTERISTICS

The present invention relates to a process for producing electrical steel sheets or strips having (100) grain structure parallel to the rolling plane. More particularly, the present invention relates to a process for producing a so-called double-oriented electrical steel sheet or strip which shows anisotropy due to the arrangement of the easily magnetizable axes in the specific directions, and further relates to a process for producing an electrical steel sheet of cube-on-face texture in which the easily magnetizable axes are arranged isotropically.

Conventionally, a grain-oriented electrical steel sheet having the so-called Goss structure in which the (110) grain structure exists on the rolling plane and the [001] easily magnetizable axis accords with the rolling direction has been used as magnetic materials for iron cores of transformers, generators, motors, etc., and such grainoriented electrical steel sheet has contributed substantially for the improvement of characteristics of electrical appliances. Until the present time, no other materials which have better properties and can replace the above grainoriented electrical steel sheet have been found.

The grain-oriented electrical steel sheet which shows excellent characteristics in the rolling direction is hardly magnetized in the [111] orientation which is at 55° to the rolling direction and in the [110] orientation, which is at 90° to the rolling direction, so that it shows a high iron loss value and a low magnetic flux density value in their orientations. Therefore, loss of the magnetic flux in the corner portion of a laminated iron core of a transformer increases, or the iron loss in case of a motor, which requires a high magnetic flux in all directions on the rolling plane increases so that low electric efficiency and increased energy consumption are caused. In order to reduce such watt loss, it is necessary to develop a doubleoriented electrical steel sheet having a (100)[001] structure in the rolling plane, or an electrical steel sheet having a cube-on-face structure in which the easily magnetizable axis is isotropic in the rolling direction. These materials contain many easily magnetizable axises in the rolling plane so that their induction value is remarkably high, and when a texture which shows anisopropy is formed they show remarkably high magnetization in the direction. These materials can enhance the performance of electrical appliances and minimanize their size and strong demand have been made for their commercial production.

One of the object of the present invention is to provide a process for producing an electrical steel sheet of cube-on-face texture which shows excellent magnetic characteristics, which comprises applying a special rolling method to the conventional production process of electrical steel sheets from steel materials including typical steel compositions for grain-oriented electrical steel sheets as well as pure iron, low-carbon steel, silicon steel, Mn-containing or Al-containing steels and special steels containing Cr, Ni, Co and Mo.

The production process of the present invention is based on the following two principles. One is that deformation to which the steel material is subjected is remarkably high because a high reduction rolling is done using a special roll in the cold rolling. Therefore, the dislocation density increases and the accumulated internal energy is maintained at high degree. This is the most suitable condition for formation of (100) grain nuclei during annealing and energy required for the grain formation is provided. In addition, by the rolling with a special roll, the flow of the material not only in the rolling direction but also in the direction at the right angle to the rolling direction is promoted to give a condition favourable to the (100) cubic texture. There is no necessity to limit the use of the special roll to the room temperature application. The special roll used herein means a roll having a plurality of grooves extending in the rolling direction or in a direction perpendicular thereto or in both directions as contrast to the conventional rolling roll having a smooth surface.

The present invention will be described referring to the attached drawings.

FIG. 1 shows an example of the grooved roll used in the present invention.

FIG. 2 (*a*) and (*b*) show respectively the pole figures in the examples of the present invention.

Figure 1:
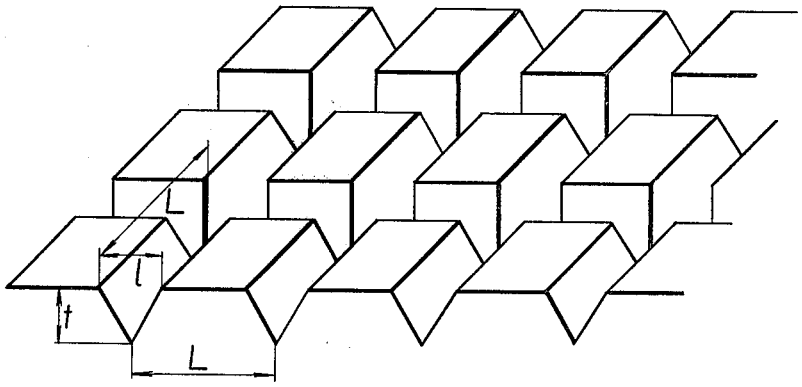

One example of the special roll used in the present invention is shown in FIG. 1. When the rolling is done with such a roll, the following unique results are obtained. Namely, the residual strain on the surfacial layer of the steel sheet rolled by the grooved roll is extraordinarily high as compared with that of a steel sheet rolled by a conventional smooth roll, so that the formation of the (110) texture from the surfacial layer as seen during recrystallization of a grain-oriented electrical steel sheet is suspended and the formation of the (100) texture from the face or central layer is promoted. Also the rolling with a grooved roll not only restricts the flow of the material in the rolling direction but also promotes the flow of the material in a direction perpendicular to the rolling direction. In this case, MnS or MnS + AlN, precipitation dispersions are arranged in correspondence to the distribution of the residual strain or the flow of the mateial, and act as so-called inhibitor during recrystallization which restricts the grain arrangement and direction and provide a condition favourable to development of double-orientation as in a cross rolling.

One example of the arrangement and shape of the groove on the special roll used in the present invention is shown in FIG. 1. The groove arrangement, groove width, depth and spacing, etc. have close relation with the development of the (100) texture. When the above factors are selected appropriately in the cross-grooved roll as shown, the roll acts as a concaved and convexed roll or a rough-surfaced roll, and it has been confirmed that the roll is effective for development for the (100) texture. The rough-surfaced roll used herein means a surface roughness not less than several microns which are considered to be a roughness limit for the ordinary smooth rolls. In any of the above cases, the surface condition of the steel sheet after the rolling has severe convex and concave and the steel sheet in this condition can not be used. Therefore, it is rolled to a predetermined plate thickness using a smooth roll.

The materials to which the present invention is directed may be any material which contains iron as main component, and have limitation in other addition elements. However, silicon steel is the most common material from the points of utility and production because it has (1) a high magnetic flux density, (2) a high resistivity, and (3) no transformation, (4) is low cost and (5) has a cubic grain structure and so on. Therefore, the following descriptions will be made mainly for the silicon steel.

The silicon steel containing silicon as the main alloying element has some limitation in the contents of carbon, nitrogen, manganese, sulfur, aluminium, etc. It is necessary to increase the content of silicon in order to increase electrical resistance and to reduce eddy current of the steel sheet, but it is limited to 5% or less in order to avoid crackings during the rolling. A certain amount of carbon is required for uniformity and refinement of the rolled structure, but it is limited in view of the subsequent decarburization annealing, and it is desirable to limit the carbon content to 0.2% or less. Manganese is important for controlling the grains and as MnS dispersion, for the inhibiting effects, but it is limited to 1% or less. Sulfur is necessary for formation of the MnS dispersion and a certain amount of sulfur is required for restricting the orientation of the texture, but it causes deterioration of the characteristics of the final products and it must be removed finally. Therefore, the sulfur content should be limited to 0.1% or less. Aluminium in solid solution state restricts the rolled structure of the steel sheet, combines with nitrogen to form AlN dispersion to produce the inhibiting effects which restricts the crystalline plane or orientation just as MnS. However, the aluminium content is limited to 5% or less because an electrical steel sheet in which the amount of aluminium is dissolved in solid solution in stead of silicon is superior for the development of the cube-on-face structure. In connection with the formation of the AlN dispersion, the nitrogen content is naturally restricted. However, it is desirable to remove nitrogen for the final product, and the nitrogen content is limited to 0.01% or less. The above limitations of the alloying elements are applied to continuously cast steel materials too.

The production process of the present invention starts from steel ingots or slabs of the above composition and comprises hot rolling and cold rolling with the special grooved roll. Descriptions will be made on the cold rolling step and subsequent steps.

A hot coiled steel strip of 2.0 – 5 mm thickness which is conventionally produced by hot rolling is used as the starting material and, if necessary, subjected to hot coil annealing at a temperature not higher than 1200°C to obtain a uniform structure, and then the both sides of the steel strip are cold rolled at high reduction of at least 50% using grooved rolls, subsequently rolled to a final thickness using smooth rolls, subjected to decarburization annealing in a wet atmosphere at a temperature not higher than $A_3$ transformation point, and finally subjected to recrystallization annealing at a temperature not higher than about 1300°C to obtain the (100) cube-on-face texture. The texture can be obtained also by a two-step cold rolling with an intermediate annealing after the rolling with the grooved roll.

The hot coil annealing which is conducted according to necessity requires 2 to 120 minutes at a temperature between 800° and 1200°C. When the temperature is at a higher side the time can be shortened. However, when the heating temperature is above 1200°C, the grains grow and the structure changes to cause undesirable results, and when the heating temperature is below 800°C, a long time of heating is required and thus a batch type annealing is desirable. Generally, a shorttime continuous annealing at 1100°C is desired. As the heating rate and cooling rate have close relation with the development of the (100) cubic texture and it is necessary to select optinum conditions.

Even if the conditions for development of the cubic texture are satisfied as above, a part of ferrite transforms into austenite when the annealing temperature is above the $A_3$ transformation point, and the orientation in this part becomes unstable and the cubic texture is weakened. In some cases all of grains transform into austenite and a predetermined grain orientation can not be obtained. Therefore, when decarburization annealing is effected at a temperature below the $A_3$ transformation point prior to the final finishing annealing, it is possible to shift the transformation point to the temperature side and to effect the annealing while the ferrite structure being retained. Such decarburization annealing can be continuously proceeded in wet hydrogen at a temperature about 80°C. And when the steel sheet contains 2% or more of silicon, the $A_3$ transformation point shifts further to the higher temperature side, the above limitation is relaxed. Regarding the decarburization, a lower carbon content is more desirable, and when the carbon content is lowered to 0.005% or lower, favourable conditions for the development of the (100) texture and characteristics thereby can be obtained. The final finishing annealing is generally effected at a high temperature for a long time, thereby the characteristics of the sheet are remarkably improved through development of secondary recrystallization, desulfurization, denitrization, etc.

The present invention will be more clearly understood from the following example.

EXAMPLE

Hot coiled 3% silicon steel strips A and B of 2.3 mm thickness as shown in Table 1 were subjected to a hot coil annealing at 1100°C for 5 minutes to make the structure and adjust the precipitation dispersions and cooled in air. Then the strips were cold rolled using the rolls as shown in FIG. 1. The groove depth was 0.25 mm, the groove width was 0.5 mm, the groove spacing was 2.0 mm, the roll diameter was 123 mm. The strips were further rolled to final thickness using smooth rolls, subjected to decarburization annealing (C : 0.005%) in wet hydrogen atmosphere at 850°C for 5 minutes, and final finishing annealing at 1100°C for 5 hours.

Figure 3:
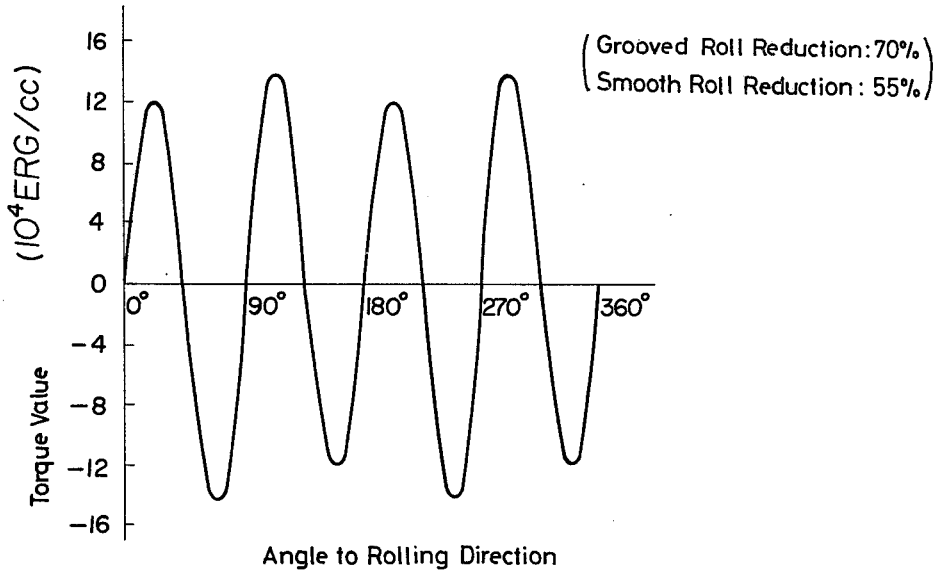
FIG. 3 is a graph showing torque curves in the example.
Figure 2:
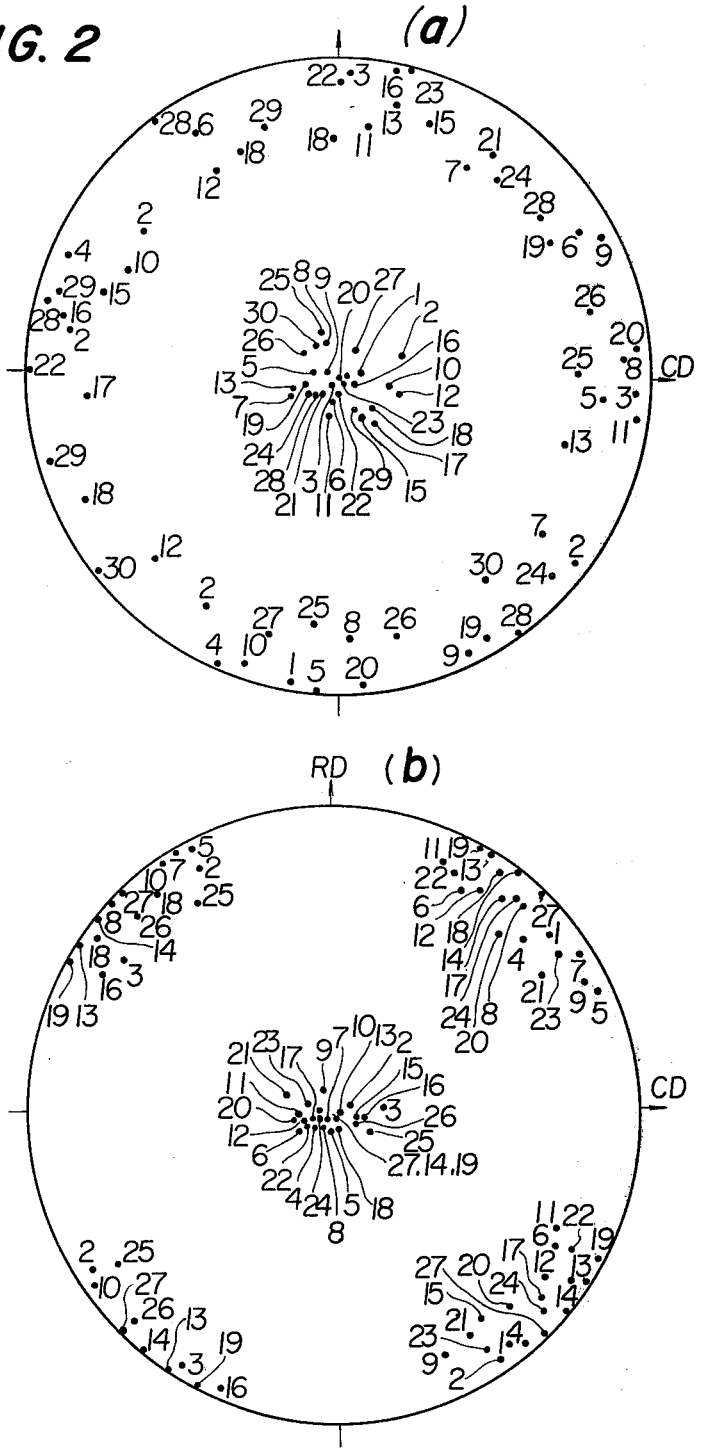

FIG. 2(*a*) is a pole figure showing the cubic texture obtained when the rolling with the grooved rolls and the rolling with the smooth rolls were 60 and 65% reductions respectively, and FIG. 2(*b*) is a pole figure showing the cubic texture obtained when the rolling with the grooved rolls and the rolling with the smooth rolls were 70 and 55% reductions, respectively. It is clear from the figures that when the rolling reduction with the grooved rolls is increased, the cubic texture has anisotropy. The corresponding torque curves are shown in FIG. 3. The magnetic characteristics of the anisotropic orientation are shown in Table 2. It is understood from the table that magnetic characteristics (W 15/50; 1.1 – 1.2 W/kg, $B_8$; about 18 KG) equivalent to those of a grain-oriented electrical steel sheet in respect of watt loss and magnetic flux density.

Figure 4:
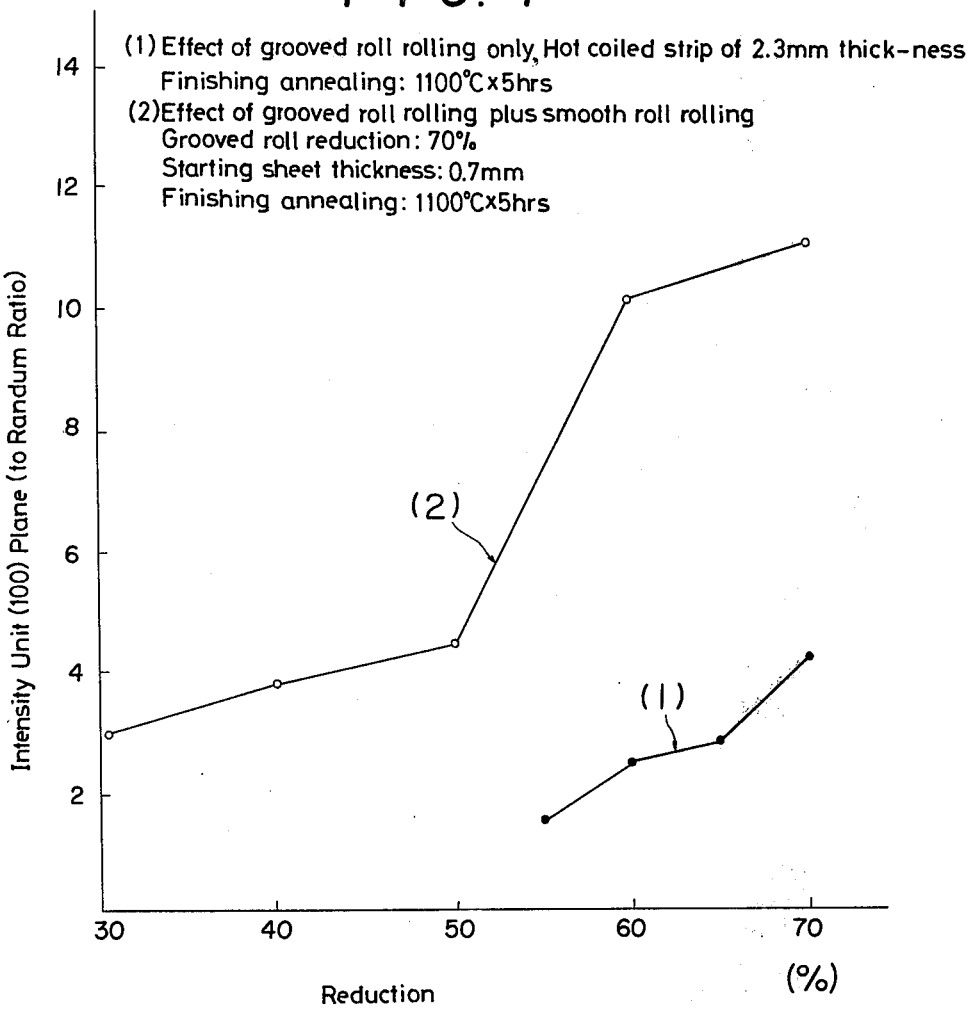
FIG. 4 is a graph showing intensity units in the example.

FIG. 4 shows the effect of the grooved roll reduction and the smooth roll reduction in the intensity unit (100), and it is clear that the (100) degree is increased when the both reductions are higher.

Table 1

| Composition | C | Si | Mn | S | Sol.Al | T.N |
|---|---|---|---|---|---|---|
| Sample A | 0.030 | 3.02 | 0.120 | 0.025 | 0.002 | 0.0056 |
| Sample B | 0.035 | 2.97 | 0.115 | 0.020 | 0.0015 | 0.0059 |

Table 2

| | $B_3$ | $B_5$ | $B_8$ | $B_{25}$ | W 10/50 | W 15/50 | W 17/50 |
|---|---|---|---|---|---|---|---|
| A | 17.470 | 18.021 | 18.274 | 18.851 | 0.51 | 1.12 | 1.351 |
| B | 16.370 | 17.210 | 17.873 | 18.239 | 0.53 | 1.24 | 1.371 |

(Average in two directions)

What is claimed is:

1. A process for producing electrical sheet steel having cubic-on-face texture comprising the steps of:

initially subjecting hot rolled steel sheet to primary cold rolling with a reduction of not less than 20% utilizing a roller having a grooved surface thereon, subsequently subjecting said steel sheet to secondary cold rolling utilizing a roller having a smooth surface thereon, subjecting said sheet to decarburization annealing and thereafter subjecting said sheet to final, finishing, recrystallization annealing.

2. A process according to claim 1 wherein said hot rolled steel sheet is annealed prior to said primary cold rolling.

* * * * *